US010755621B2

(12) United States Patent
Wang

(10) Patent No.: US 10,755,621 B2
(45) Date of Patent: Aug. 25, 2020

(54) TIMING CONTROLLER, TIMING CONTROL METHOD AND DISPLAY PANEL

(71) Applicant: BOE Technology Group Co., Ltd., Beijing (CN)

(72) Inventor: Yanfeng Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 162 days.

(21) Appl. No.: 15/546,999

(22) PCT Filed: Apr. 15, 2016

(86) PCT No.: PCT/CN2016/079352
§ 371 (c)(1),
(2) Date: Jul. 27, 2017

(87) PCT Pub. No.: WO2016/206451
PCT Pub. Date: Dec. 29, 2016

(65) Prior Publication Data

US 2018/0025685 A1 Jan. 25, 2018

(30) Foreign Application Priority Data

Jun. 25, 2015 (CN) ..... 2015 1 0359575

(51) Int. Cl.
*G09G 3/20* (2006.01)
*G09G 3/36* (2006.01)
(Continued)

(52) U.S. Cl.
CPC ..... *G09G 3/2092* (2013.01); *G09G 3/006* (2013.01); *G09G 3/20* (2013.01); *G09G 3/36* (2013.01);
(Continued)

(58) Field of Classification Search
CPC ..... G09G 3/20; G09G 3/2092; G09G 3/006; G09G 3/36; G09G 2300/0426;
(Continued)

(56) References Cited

U.S. PATENT DOCUMENTS

2002/0008682 A1* 1/2002 Park ..... G09G 3/20 345/87
2002/0075214 A1* 6/2002 Kim ..... G02F 1/13452 345/88
(Continued)

FOREIGN PATENT DOCUMENTS

CN 1667689 9/2005
CN 101055712 10/2007
(Continued)

OTHER PUBLICATIONS

International Search Report from corresponding PCT Application No. PCT/CN2016/079352, dated Jun. 29, 2016 (3 pages).
(Continued)

*Primary Examiner* — Jeff Piziali
(74) *Attorney, Agent, or Firm* — Dave Law Group LLC; Raj S. Dave

(57) ABSTRACT

A timing controller includes a synchronization module for controlling at least one of a sending time point of a first drive control signal and a sending time point of a second drive control signal, such that the first drive control signal reaches a first driving circuit at the same time point as the second drive control signal reaches a second driving circuit. By controlling the sending time points at which the first drive control signal and the second drive control signal are sent, the two drive control signals are enabled to simultaneously reach the two driving circuits, to achieve the synchronous control of such two driving circuits.

16 Claims, 4 Drawing Sheets

(51) Int. Cl.
*G09G 3/00* (2006.01)
*G09G 3/3208* (2016.01)

(52) U.S. Cl.
CPC ... *G09G 3/3208* (2013.01); *G09G 2300/0426* (2013.01); *G09G 2310/06* (2013.01); *G09G 2310/08* (2013.01); *G09G 2320/02* (2013.01)

(58) Field of Classification Search
CPC ..... G09G 3/3208; G09G 2310/06; G09G 2310/08; G09G 2320/02
See application file for complete search history.

(56) References Cited

U.S. PATENT DOCUMENTS

2004/0201563 A1 10/2004 Kobayashi
2004/0227716 A1* 11/2004 Lin ..... G09G 3/3648 345/99
2005/0200587 A1 9/2005 Hwang
2006/0214928 A1* 9/2006 Koyama ..... G09G 3/3648 345/204
2007/0236486 A1 10/2007 Ku
2008/0001895 A1* 1/2008 Choi ..... G09G 3/3648 345/98
2010/0156879 A1* 6/2010 Hong ..... G09G 3/3648 345/213
2010/0156885 A1 6/2010 Cho et al.
2010/0225637 A1* 9/2010 Jeon ..... G09G 3/20 345/213
2010/0283777 A1* 11/2010 Sang ..... G09G 3/3696 345/212
2012/0056857 A1* 3/2012 Li ..... G09G 3/20 345/204
2012/0242628 A1* 9/2012 Yuan ..... G09G 3/20 345/204
2013/0021306 A1* 1/2013 Kuo ..... G09G 3/20 345/204
2014/0009450 A1* 1/2014 Su ..... G09G 5/001 345/204
2014/0210699 A1 7/2014 Liu et al.
2015/0294614 A1 10/2015 Duan et al.
2015/0379949 A1 12/2015 Wang et al.

FOREIGN PATENT DOCUMENTS

CN 101645246 2/2010
CN 103236241 8/2013
CN 103531169 1/2014
CN 104464601 3/2015
CN 104900208 9/2015
JP 2004-309824 11/2004
WO 2015/062262 5/2015

OTHER PUBLICATIONS

Written Opinion of the International Searching Authority from corresponding PCT Application No. PCT/CN2016/079352, dated Jun. 29, 2016 (5 pages).
Office Action from corresponding Chinese application No. 201510359575.7, dated Dec. 1, 2016 (7 pages).

* cited by examiner

TIMING CONTROLLER, TIMING CONTROL METHOD AND DISPLAY PANEL

CROSS-REFERENCE TO RELATED APPLICATION

This application claims the benefit and priority of Chinese Patent Application No. 201510359575.7, filed on Jun. 25, 2015, the entire content of which is incorporated by reference herein as part of the present application.

BACKGROUND

The present disclosure relates to the technical field of display, and more particularly, to a timing controller, a timing control method and a display panel.

At present, a display panel (such as a liquid crystal panel, an organic light emitting diode panel, etc.) mainly uses a timing controller to transmit drive control signals (for example, a gate start signal, a gate clock signal or a data clock signal) to driving circuits of the display panel respectively, to control the driving circuits of the display panel. Among a plurality of driving circuits, there are usually different driving circuits that need to be synchronously driven. For example, in a display panel structure, a plurality of driving circuits is distributed on both sides of a column-directional center line of the display panel, and the driving circuits that are symmetric with respect to the column-directional center line need to be synchronously driven. However, due to the difference in signal transmission paths on both sides of the column-directional center line, or for other various reasons, the drive control signal cannot reach two driving circuits that are symmetric with respect to the column-directional center line at the same time. This causes the problem of a poor picture quality, and an affected visual effect.

BRIEF DESCRIPTION

Embodiments of the present disclosure provide a timing controller, a timing control method, and a display panel.

A first aspect of the present disclosure provide a timing controller including a synchronization module configured to control at least one of a sending time point of a first drive control signal and a sending time point of a second drive control signal, such that the first drive control signal reaches a first driving circuit at the same time point as the second drive control signal reaches a second driving circuit.

In embodiments of the present disclosure, the first driving circuit and the second driving circuit are symmetric with respect to a column-directional center line of a display panel including the timing controller.

In embodiments of the present disclosure, the first driving circuit and the second driving circuit are both gate driving circuits, and the first drive control signal and the second drive control signal are both gate start signals or both gate clock signals.

In embodiments of the present disclosure, the first driving circuit and the second driving circuit are both source driving circuits, and the first drive control signal and the second drive control signal are both data clock signals.

In embodiments of the present disclosure, the synchronization module includes a difference determination sub-module and a sending time point control sub-module. The difference determination sub-module is configured to determine a transmission time required for a first test signal to be sent from the timing controller to the first driving circuit, a transmission time required for a second test signal to be sent from the timing controller to the second driving circuit, and a difference T1 therebetween. The sending time point control sub-module is configured to send a drive control signal to a driving circuit corresponding to a longer transmission time earlier by the difference T1 than send a drive control signal to a driving circuit corresponding to a shorter transmission time.

In embodiments of the present disclosure, the timing controller has a first test signal output terminal, a first test signal return terminal, a second test signal output terminal, and a second test signal return terminal. The difference determination sub-module is configured to determine transmission times and the difference T1 therebetween, based on a time point at which the first test signal is sent from the first signal output terminal, a time point at which the first test signal is returned to the first test signal return terminal via the first driving circuit, a time point at which the second test signal is sent from the second test signal output terminal, and a time point at which the second test signal is returned to the second test signal return terminal via the second driving circuit.

A second aspect of the present disclosure provide a timing control method for controlling the timing controller described above, including: controlling at least one of a sending time point of a first drive control signal and a sending time point of a second drive control signal, such that the first drive control signal reaches a first driving circuit at the same time point as the second drive control signal reaches a second driving circuit.

In embodiments of the present disclosure, the first driving circuit and the second driving circuit are symmetric with respect to a column-directional center line of a display panel utilizing the timing control method.

In embodiments of the present disclosure, the first driving circuit and the second driving circuit are both gate driving circuits, and the first drive control signal and the second drive control signal are both gate start signals or both gate clock signals.

In embodiments of the present disclosure, the first driving circuit and the second driving circuit are both source driving circuits, and the first drive control signal and the second drive control signal are both data clock signals.

In embodiments of the present disclosure, controlling at least one of a sending time point of a first drive control signal and a sending time point of a second drive control signal includes: determining a transmission time required for the first test signal to be sent from the timing controller to the first driving circuit, a transmission time required for the second test signal to be sent from the timing controller to the second driving circuit and the difference T1 therebetween; and sending a drive control signal to a driving circuit corresponding to a longer transmission time earlier by the difference T1 than sending a drive control signal to a driving circuit corresponding to a shorter transmission time.

In embodiments of the present disclosure, the timing controller has a first test signal output terminal, a first test signal return terminal, a second test signal output terminal, and a second test signal return terminal. The transmission times and the difference T1 therebetween are determined, based on a time point at which the first test signal is sent from the first signal output terminal, a time point at which the first test signal is returned to the first test signal return terminal via the first driving circuit, a time point at which the second test signal is sent from the second test signal output terminal, and a time point at which the second test signal is returned to the second test signal return terminal via the second driving circuit.

A third aspect of the present disclosure provide a display panel including any one of the above described timing controllers, and a first driving circuit and a second driving circuit that need to be driven synchronously. The first driving circuit and the second driving circuit are both connected to the timing controller.

In embodiments of the present disclosure, the first driving circuit and the second driving circuit are symmetric with respect to a column-directional center line of the display panel.

In embodiments of the present disclosure, the display panel further includes a first source printed circuit board and a second source printed circuit board connected to an array substrate of the display panel. The timing controller is provided on the first source printed circuit board or the second source printed circuit board.

In embodiments of the present disclosure, a first test signal output terminal and a first test signal return terminal of the timing controller are both connected to the first driving circuit, a second test signal output terminal and a second test signal return terminal of the timing controller are both connected to the second driving circuit.

BRIEF DESCRIPTION OF THE DRAWINGS

The features and advantages of the present disclosure can be understood more clearly with reference to the accompanying drawings, which are illustrative and shall not to be construed as limiting the disclosure in any way, wherein.

DETAILED DESCRIPTION

The present disclosure will now be further described in detail with reference to the accompanying drawings and specific embodiments in order to provide a clearer understanding of the above features and advantages of the present disclosure. It is to be noted that the embodiments of the present application and the features in the embodiments may be combined with each other without conflict.

Many specific details are set forth in the following description to facilitate a thorough understanding of the disclosure, but the disclosure may be practiced otherwise than that described herein, and thus the scope of the disclosure is not limited to the following disclosure of the specific embodiments.

Figure 1:
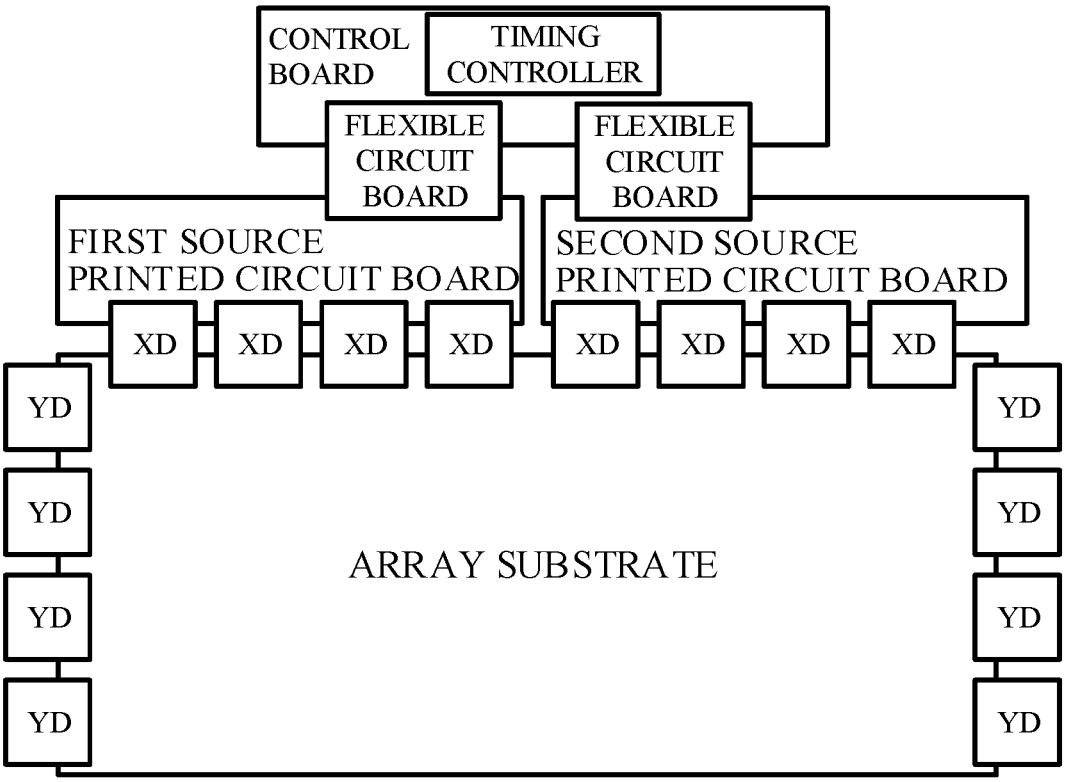
FIG. 1 shows a schematic structural diagram of a exemplary display panel.

FIG. 1 shows a schematic structural diagram of a exemplary display panel. In order to make drive control signals reach two driving circuits that are symmetric with respect to a column-directional center line of the display panel at the same time point as much as possible, a timing controller is usually provided on the column-directional center line of the display panel. As shown in FIG. 1, the timing controller is provided on a control board outside a first source printed circuit board and a second source printed circuit board, and is located approximately on the column-directional center line of the display panel. The control board is connected to the first source printed circuit board and the second source printed circuit board respectively through flexible circuit boards. The drive control signals sent from the timing controller reach the first source printed circuit board and the second source printed circuit board respectively via the flexible circuit boards, and further reach corresponding driving circuits (e.g., a gate driving circuit YD or a source driving circuit XD). Since the drive control signals generated by the timing controller need to reach the driving circuits via the control board, the flexible circuit board and the source printed circuit boards, the signal transmission path is very long. Such circuit arrangement manner can only reduce as much as possible the difference of times at which the drive control signals reach the two driving circuits described above, but cannot guarantee that the drive control signals can reach the two driving circuits above described at the same time point.

Embodiments of the present disclosure provide a timing control method for controlling the timing controller. The method including: controlling at least one of a sending time point of a first drive control signal and a sending time point of a second drive control signal, such that a first drive control signal reaches the first driving circuit at the same time point as a second drive control signal reaches the second driving circuit.

In embodiments of the present disclosure, the first driving circuit and the second driving circuit are driving circuits that need to be driven synchronously. For example, they may be driving circuits that are symmetric with respect to a column-directional center line of the display panel utilizing the timing control method.

Embodiments of the present disclosure provide the timing control method. By controlling at least one of a sending time point of a first drive control signal and a sending time point of a second drive control signal, the method enables two drive control signals to simultaneously reach the two driving circuits (e.g., driving circuits that are symmetric with respect to the column-directional center line of the display panel). The synchronous control of such two driving circuits is achieved, to avoid display problems.

In embodiments of the present disclosure, the first driving circuit and the second driving circuit herein may be both gate driving circuits, and the first drive control signal and the second drive control signal may be both gate start signals or both gate clock signals. Alternatively, the first driving circuit and the second driving circuit may be both source driving circuits, and the first drive control signal and the second drive control signal may be both data clock signals.

In embodiments of the present disclosure, controlling at least one of a sending time point of a first drive control signal and a sending time point of a second drive control signal may specifically include: determining a transmission time required for the first test signal to be sent from the timing controller to the first driving circuit, a transmission time required for the second test signal to be sent from the timing controller to the second driving circuit, and the difference T1 therebetween; sending a drive control signal to a driving circuit corresponding to a longer transmission time earlier by the difference T1 than sending a drive control signal to a driving circuit corresponding to a shorter transmission time.

In this way, it is only required to acquire the transmission times required for the test signals to be transmitted to the two driving circuits and the difference therebetween, so as to achieve the synchronization correspondingly. The process is simple to implement.

In embodiments of the present disclosure, there are various methods for determining the transmission times for the signals to reach the driving circuits and the difference T1 therebetween. For example, on the timing controller, a first test signal output terminal, a first test signal return terminal, a second test signal output terminal and a second test signal return terminal are provided. The transmission times and the difference T1 therebetween described above can be obtained as follows: determining the transmission times and the difference T1 therebetween, based on a time point at which the first test signal is sent from the first signal output terminal, a time point at which the first test signal is returned to the first test signal return terminal via the first driving circuit, a time point at which the second test signal is sent from the second test signal output terminal, and a time point at which the second test signal is returned to the second test signal return terminal via the second driving circuit.

By providing four terminals or pins on the timing controller, the above method can calculate the transmission times and the difference T1 therebetween, only using the time points at which the test signals are sent from or returned to the corresponding terminals or pins. The method has the advantages of being easy to implement and simple to calculate.

Of course, in embodiments of the present disclosure, it is also possible to determine the transmission times and the difference T1 therebetween by detecting the time points at which the test signals are sent and the time points at which the test signals reach the corresponding driving circuits. This method does not necessarily use the terminals or pins on the timing controller for detection.

In embodiments of the present disclosure, the above described timing control method may be specifically executed by the timing controller. The timing controller includes a synchronization module for controlling at least one of a sending time point of a first drive control signal and a sending time point of a second drive control signal, such that the first drive control signal reaches the first driving circuit at the same time point as the second drive control signal reaches the second driving circuit.

In embodiments of the present disclosure, the first driving circuit and the second driving circuit are driving circuits that need to be driven synchronously. For example, they may be driving circuits that are symmetric with respect to the column-directional center line of a display panel including the timing controller.

The timing controller provided by the present disclosure has a synchronization module capable of controlling the sending time points of the first drive control signal and the second drive control signal, such that two drive control signals can simultaneously reach the two driving circuits (for example, two driving circuits that are symmetric with respect to a column-directional center line of the display panel). The simultaneous control of these two driving circuits is achieved, so as to avoid the resulting display problems because the drive control signals cannot simultaneously reach the two driving circuits that are symmetric with respect to the column-directional center line of the display panel.

In embodiments of the present disclosure, the synchronization module may include a difference determination sub-module and a sending time point control sub-module. The difference determination sub-module is used for determining a transmission time required for the first test signal to be sent from the timing controller to the first driving circuit, a transmission time required for the second test signal to be sent from the timing controller to the second driving circuit, and the difference T1 therebetween. The sending time point control sub-module is used for sending a drive control signal to a driving circuit corresponding to a longer transmission time earlier by the difference T1 than sending a drive control signal to a driving circuit corresponding to a shorter transmission time.

In this way, it is only required to use the difference determination sub-module to determine the transmission times required for the test signals to be transmitted to the two driving circuits and the difference T1 therebetween. Then, the sending time point control sub-module is used to control the time points at which the drive control signals are sent, to achieve the synchronization correspondingly. The process is simple to implement.

In embodiments of the present disclosure, the timing controller may further have a first test signal output terminal, a first test signal return terminal, a second test signal output terminal, and a second test signal return terminal. At this point, the difference determination sub-module can use the above four terminals or pins to determine the transmission times and the difference T1 therebetween.

The difference determination sub-module is specifically used for determining the transmission times and the difference T1 therebetween, based on a time point at which the first test signal is sent from the first signal output terminal, a time point at which the first test signal is returned to the first test signal return terminal via the first driving circuit, a time point at which the second test signal is sent from the second test signal output terminal, and a time point at which the second test signal is returned to the second test signal return terminal via the second driving circuit.

By providing four terminals or pins on the timing controller, the transmission times and the difference T1 can be calculated only using the time points at which the test signals are sent from or returned to the corresponding terminals or pins. The method has the advantages of being easy to implement and simple to calculate.

Embodiments of the present disclosure further disclose a display panel, including the above described timing controller, and a first driving circuit and a second driving circuit that need to be driven synchronously (for example, the first driving circuit and the second driving circuit that are symmetric with respect to the column-directional center line of the display panel). The first driving circuit and the second driving circuit are both connected to the timing controller. Since the above described timing controller can make the drive control signals simultaneously reach the two driving circuits that are symmetric with respect to the column-directional center line of the display panel, the display panel having the above timing controller has the advantage that the drive control signals can simultaneously control the two driving circuits that are symmetric with respect to the column-directional center line of the display panel.

Further, since the above described timing controller can make the drive control signals simultaneously reach the two driving circuits that are symmetric with respect to the column-directional center line of the display panel, the timing controller executing the above described timing control method is not necessarily provided on the column-directional center line of the display panel to which it belongs, but rather can be flexibly arranged. The design difficulty or production costs may be greatly reduced.

Figure 2:
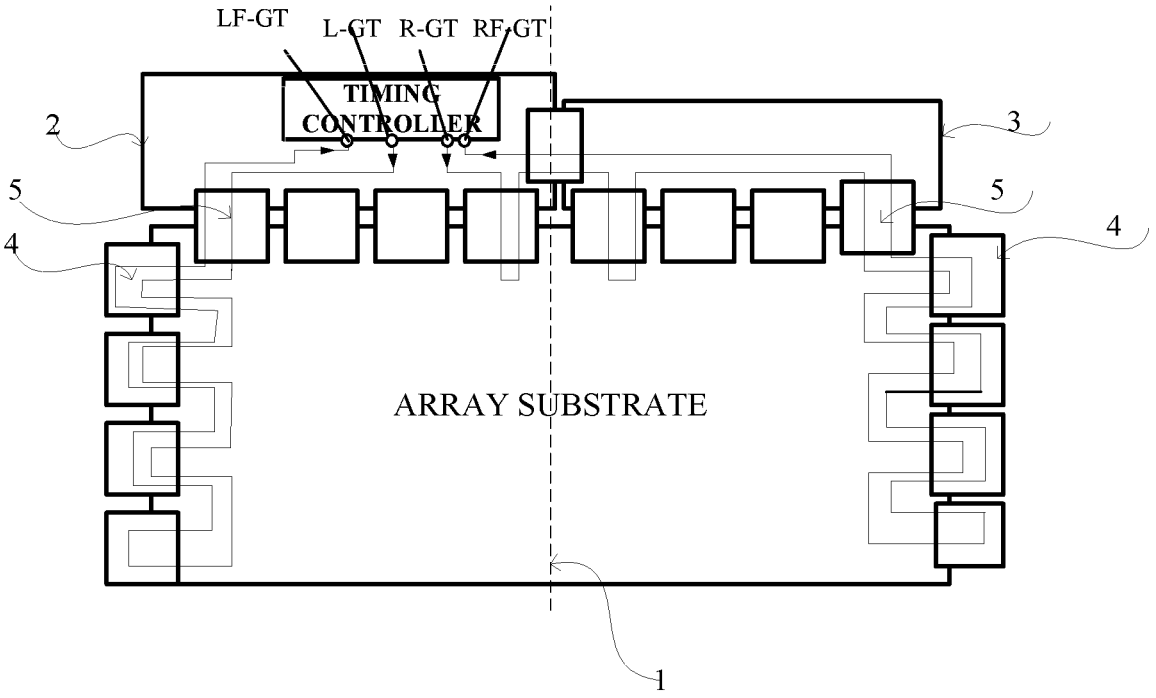
FIG. 2 shows a schematic diagram of a transmission loop for a test signal according to an embodiment of the present disclosure.
Figure 3:
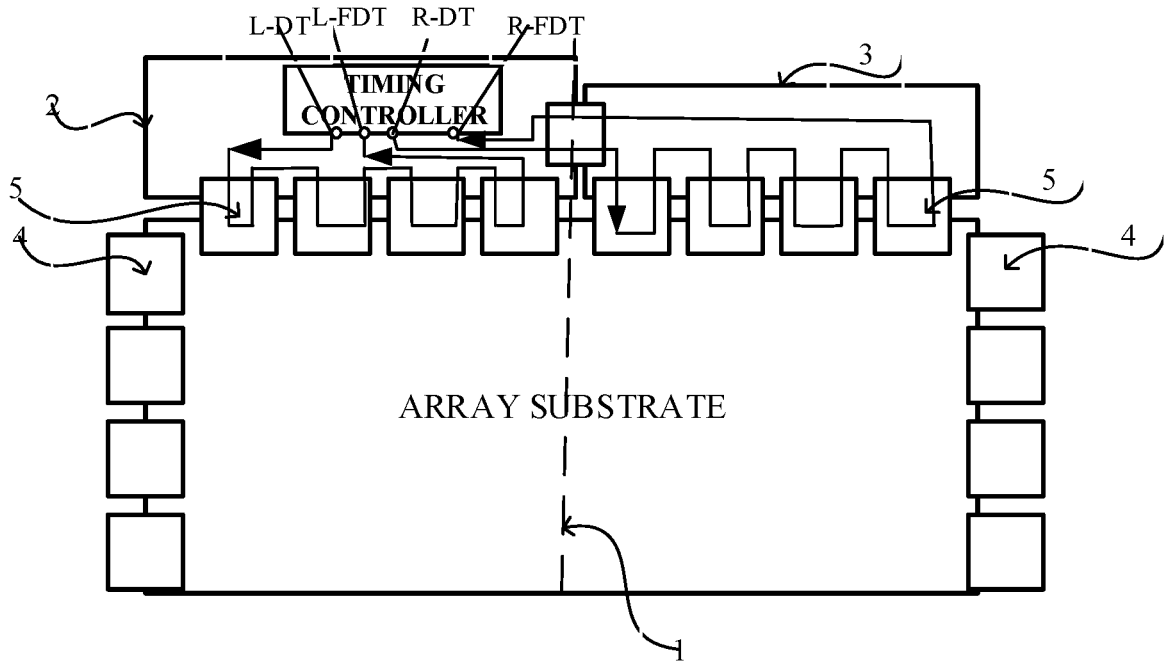
FIG. 3 shows a schematic diagram of a transmission loop for a test signal according to another embodiment of the present disclosure.

FIG. 2 shows a schematic diagram of a transmission loop for a test signal according to an embodiment of the present disclosure. FIG. 3 shows a schematic diagram of a transmission loop for a test signal according to another embodiment of the present disclosure. As shown in FIGS. 2 and 3, the display panel has an array substrate, a plurality of gate driving circuits 4 and a plurality of source driving circuits 5 provided on the array substrate, a first source printed circuit board 2, a second source printed circuit board, and a timing controller 3. The dotted line in the figures represents the column-directional center line 1 of the display panel, and the arrangement of the gate driving circuits and the source driving circuits is the same as FIG. 1. That is, the gate driving circuits 4 are symmetrically provided with respect to the column-directional center line 1, and the source driving circuits 5 are also symmetrically provided with respect to the column-directional center line 1. Based on the advantage of flexible arrangement of the timing controller, the timing controller is provided on the first source printed circuit board 2 in the figures. Of course, the timing controller may also be provided on the second source printed circuit board. Compared to the display panel in FIG. 1, the display panel in FIGS. 2 and 3 saves one control board and two flexible circuit boards in structure, which not only makes the structure simple, but also saves material costs and assembly costs.

In order to realize the determination of the transmission times and the difference T1 therebetween using the four terminals or pins of the timing controller in the above described timing control method, the transmission loops for the first test signal and the second test signal may further be formed on the display panel in FIGS. 2 and 3.

The first test signal output terminal L-GT and the first test signal return terminal LF-GT of the timing controller on the display panel in FIG. 2 are connected to the gate driving circuit 4 on one side of the column-directional center line 1 of the display panel, to form the transmission loop for the first test signal. The second test signal output terminal R-GT and the second test signal return terminal RF-GT of the timing controller are connected to the gate driving circuit 4 on the other side of the column-directional center line 1 of the display panel, to form the transmission loop for the second test signal. The transmission loop for the first test signal and the transmission loop for the second test signal are used to determine the transmission times and the difference T1 therebetween, and further control the time points at which the gate start signals or the gate clock signals are sent so that the gate start signals or the gate clock signals can simultaneously reach the two gate driving circuits that are symmetric with respect to the column-directional center line of the display panel.

The first test signal output terminal L-DT and the first test signal return terminal L-FDT of the timing controller on the panel shown in FIG. 3 are connected to the source driving circuit 5 on one side of the column-directional center line 1 of the display panel, to form the transmission loop for the first test signal. The second test signal output terminal R-DT and the second test signal return terminal R-FDT of the timing controller are connected to the source driving circuits 5 on the other side of the column-directional center line 1 of the display panel, to form the transmission loop for the second test signal. The transmission loop for the first test signal and the transmission loop for the second test signal are used to determine the transmission times and the difference T1 therebetween, and further control the time points at which the data clock signals are sent so that the source drive signals (for example, the data clock signals) can simultaneously reach the two source driving circuits that are symmetric with respect to the column-directional center line of the display panel.

The specific process of the timing control method provided by the embodiment of the present disclosure will be described below with reference to the display panel shown in FIGS. 2 and 3.

Referring to FIG. 2, taking the case where the first drive control signal and the second drive control signal are both gate start signals or gate clock signals as an example, the transmission process of the test signals is as follows.

The first test signal is sent from the first test signal output terminal L-GT of the timing controller, sequentially passes through each unit of the gate driving circuit on one side of the column-directional center line of the display panel, and then returns to the first test signal return terminal LF-GT of the timing controller, along the signal transmission loop. The second test signal is sent from the second test signal output terminal R-GT of the timing controller, sequentially passes through each unit of the gate driving circuit on the other side of the column-directional center line of the display panel along the signal transmission loop, and then returns to the second test signal return terminal RF-GT of the timing controller.

The transmission time t1 of the first test signal is obtained from the time difference between the time point at which the first test signal is sent from the L-GT pin and the time point at which it is returned to the LF-GT pin. The transmission time t2 of the second test signal is obtained from the time difference between the time point at which the second test signal is sent from the R-GT pin and the time point at which it is returned to the RF-GT pin. The difference between the transmission time t1 of the first test signal and the transmission time t2 of the second test signal is twice the difference T1, i.e. $T1=|t1-t2|/2$.

Figure 4:
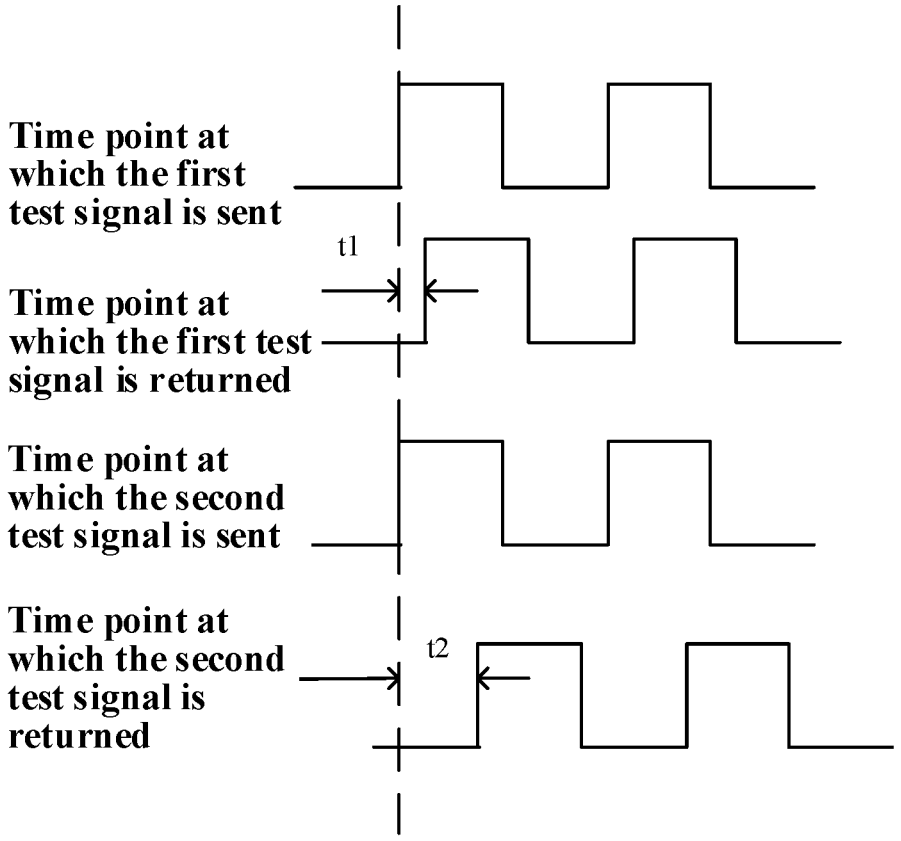
FIG. 4 shows a comparison diagram of a time point at which a test signal is sent and a time point at which the test signal is returned according to an embodiment of the present disclosure.
Figure 5:
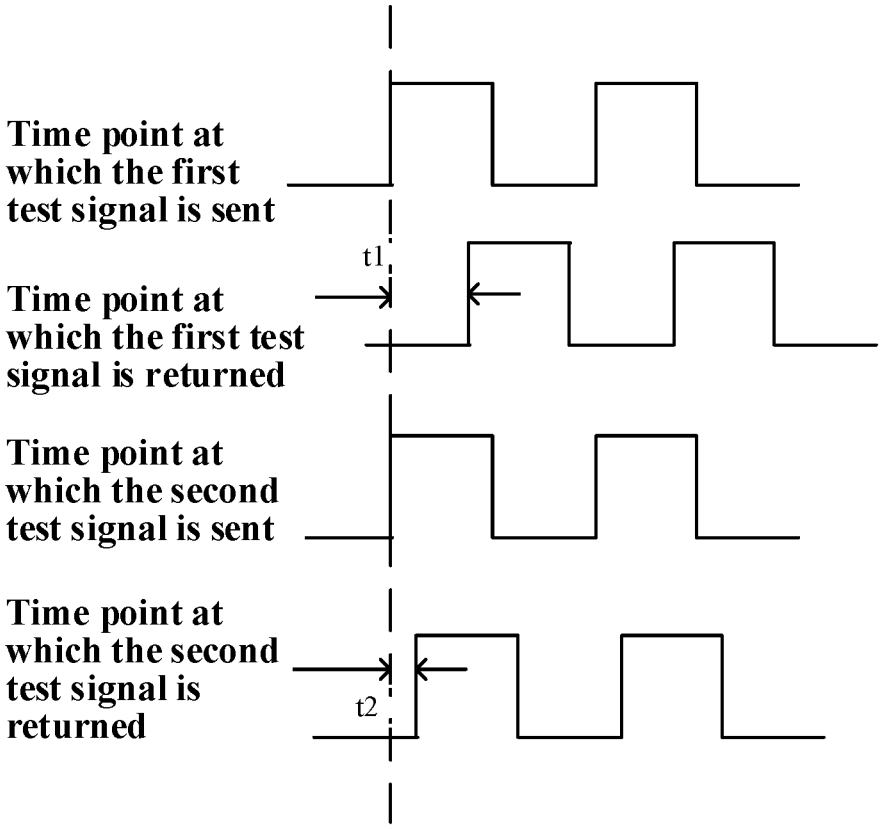
FIG. 5 shows another comparison diagram of the time point at which a test signal is sent and the time point at which the test signal is returned according to an embodiment of the present disclosure.

FIG. 4 shows a comparison diagram of the time point at which a test signal is sent and the time point at which the test signal is returned according to an embodiment of the present disclosure. FIG. 5 shows another comparison diagram of the time point at which a test signal is sent and the time point at which the test signal is returned according to an embodiment of the present disclosure.

As shown in FIG. 4, if $t1<t2$, it is indicated that the transmission time of the first test signal is shorter than the transmission time of the second test signal. The sending time point of the second drive control signal is set earlier by T1 than the sending time point of the first drive control signal.

As shown in FIG. 5, if $t1>t2$, it is indicated that the transmission time of the first test signal is longer than the transmission time of the second test signal. The sending time point of the first drive control signal is sent earlier by T1 than the sending time point of the second drive control signal is sent.

The above conclusions can also be described in the following table.

| | | | | | |
|---|---|---|---|---|---|
| Time point at which first test signal is sent | 0 | Time point at which first drive control signal is sent | 0 | Time point at which first drive control signal is sent | T1 (t2 > t1) |
| Time point at which second test signal is sent | 0 | Time point at which second drive control signal is sent | T1 (t1 > t2) | Time point at which second drive control signal is sent | 0 |
| Time point at which first test signal is returned | t1 | | | | |
| Time point at which second test signal is returned | t2 | | | | |

Referring to FIG. 3, taking the case where the first drive control signal and the second drive control signal are both data clock signals as an example, the transmission process of the test signal is as follows.

The first test signal is sent from the first test signal output terminal L-DT of the timing controller, sequentially passes through each unit of the source driving circuit on one side of the column-directional center line of the display panel, and then returns to the first test signal return terminal L-FDT of the timing controller, along the signal transmission loop. The second test signal is sent from the second test signal output terminal R-DT of the timing controller, sequentially passes through each unit of the source driving circuits on the other side of the column-directional center line of the display panel, and then returns to the second test signal return terminal R-FDT of the timing controller, along the signal transmission loop.

The transmission time t3 of the first test signal is obtained from the time difference between the time point at which the first test signal is sent from the L-DT pin and the time point at which it is returned to the L-FDT pin. The transmission time t4 of the second test signal is obtained from the time difference between the time point at which the second test signal is sent from the R-DT pin and the time point at which it is returned to the R-FDT pin. The difference between the transmission time t3 of the first test signal and the transmission time t4 of the second test signal is twice the difference T1, i.e. $T1=|t3-t4|/2$.

If $t3<t4$, it is indicated that the transmission time of the first test signal is shorter than the transmission time of the second test signal. The sending time point of the second drive control signal is set earlier by T1 than the sending time point of the first drive control signal.

If $t3>t4$, it is indicated that the transmission time of the first test signal is longer than the transmission time of the second test signal. The sending time point of the first drive control signal is set earlier by T1 than the sending time point of the second drive control signal.

The above conclusions can also be described in the following table.

| | | | | | |
|---|---|---|---|---|---|
| Time point at which first test signal is sent | 0 | Time point at which first drive control signal is sent | 0 | Time point at which first drive control signal is sent | T1 (t4 > t3) |
| Time point at which second test signal is sent | 0 | Time point at which second drive control signal is sent | T1 (t3 > t4) | Time point at which second drive control signal is sent | 0 |
| Time point at which first test signal is returned | t3 | | | | |
| Time point at which second test signal is returned | t4 | | | | |

The timing control process of the above timing control method is described with reference to the display panel in FIGS. 2 and 3. It is to be understood that the above timing control method is not limited to be used in the display panel in FIGS. 2 and 3. The timing control method may also be applied to other structure of display panel (for example, the display panel shown in FIG. 1).

While the embodiments of the present disclosure have been described in combination with the accompanying drawings, those skilled in the art can make various modifications and variations without departing from the spirit and scope of the disclosure, and such modifications and variations fall within the scope defined by the attached claims.

What is claimed is:

1. A timing controller comprising:

a first test signal output terminal;

a first test signal return terminal;

a second test signal output terminal; and a second test signal return terminal, wherein the timing controller is configured to control a sending time point of a first drive control signal and a sending time point of a second drive control signal, such that the first drive control signal reaches a first driving circuit at the same time point as the second drive control signal reaches a second driving circuit, by:

determining a first transmission time required for a first test signal to be sent from the timing controller to the first driving circuit according to a time point at which the first test signal is sent from the first signal output terminal and a time point at which the first test signal is returned to the first test signal return terminal via the first driving circuit, wherein the first test signal sequentially passes through each unit of the first driving circuit;

determining a second transmission time required for a second test signal to be sent from the timing controller to the second driving circuit according to a time point at which the second test signal is sent from the second test signal output terminal and a time point at which the second test signal is returned to the second test signal return terminal via the second driving circuit, wherein the second test signal sequentially passes through each unit if the second driving circuit;

determining a difference T1 between the determined first transmission time and the determined second transmission time, wherein T1=|the first transmission time−the second transmission time|/2; and sending the first or second drive control signal to the respective first or second driving circuit inversely corresponding to a shorter one of the determined first and second transmission times, waiting the determined difference T1, and then sending the other of the first or second drive control signal to the respective first or second driving circuit directly corresponding to a shorter one of the determined first and second transmission times at the end of the determined difference T1.

2. The timing controller according to claim 1, wherein the first driving circuit and the second driving circuit are symmetric with respect to a column-directional center line of a display panel comprising the timing controller.

3. The timing controller according to claim 1, wherein the first driving circuit and the second driving circuit are both gate driving circuits, and wherein the first drive control signal and the second drive control signal are both gate clock signals.

4. The timing controller according to claim 1, wherein the first driving circuit and the second driving circuit are both source driving circuits, and wherein the first drive control signal and the second drive control signal are both data clock signals.

5. A timing control method for controlling the timing controller according to claim 1, the method comprising:

controlling a sending time point of the first drive control signal and a sending time point of the second drive control signal, such that the first drive control signal reaches the first driving circuit at the same time point as the second drive control signal reaches the second driving circuit.

6. The method according to claim 5, wherein the first driving circuit and the second driving circuit are symmetric with respect to a column-directional center line of a display panel utilizing the timing control method.

7. The method according to claim 5, wherein the first driving circuit and the second driving circuit are both gate driving circuits, and wherein the first drive control signal and the second drive control signal are both gate clock signals.

8. The method according to claim 5, wherein the first driving circuit and the second driving circuit are both source driving circuits, and wherein the first drive control signal and the second drive control signal are both data clock signals.

9. The method according to claim 5, wherein controlling the sending time point of the first drive control signal and the sending time point of the second drive control signal comprises:

determining the first transmission time required for the first test signal to be sent from the timing controller to the first driving circuit, the second transmission time required for the second test signal to be sent from the timing controller to the second driving circuit, and the difference T1 therebetween; and sending the first or second drive control signal to the respective first or second driving circuit corresponding to the longer one of the first and second transmission times, waiting the determined difference T1, and then sending the other of the first and second drive control signal to the respective first or second driving circuit corresponding to a shorter one of the first or second transmission times at the end of the determined difference T1.

10. A display panel comprising:

the timing controller according to claim 1, and the first driving circuit and the second driving circuit that need to be driven synchronously;

wherein the first driving circuit and the second driving circuit are both connected to the timing controller.

11. The display panel according to claim 10, wherein the first driving circuit and the second driving circuit are symmetric with respect to a column-directional center line of the display panel.

12. The display panel according to claim 10, further comprising:

a first source printed circuit board and a second source printed circuit board connected to an array substrate of the display panel;

wherein the timing controller is provided positioned on the first source printed circuit board or the second source printed circuit board.

13. The display panel according to claim 10, wherein the first test signal output terminal and the first test signal return terminal of the timing controller are both connected to the first driving circuit; and wherein the second test signal output terminal and the second test signal return terminal of the timing controller are both connected to the second driving circuit.

14. The timing controller according to claim 2, wherein the first driving circuit and the second driving circuit are both gate driving circuits, and wherein the first drive control signal and the second drive control signal are both gate clock signals.

15. The timing controller according to claim 2, wherein the first driving circuit and the second driving circuit are both source driving circuits, and wherein the first drive control signal and the second drive control signal are both data clock signals.

16. The method according to claim 6, wherein the first driving circuit and the second driving circuit are both gate driving circuits, and wherein the first drive control signal and the second drive control signal are both gate clock signals.

* * * * *